US007738667B2

(12) United States Patent
Bramsløw et al.

(10) Patent No.: US 7,738,667 B2
(45) Date of Patent: Jun. 15, 2010

(54) HEARING AID FOR RECORDING DATA AND LEARNING THEREFROM

(75) Inventors: Lars Bramsløw, Smørum (DK); Henrik Lodberg Olsen, Smørum (DK); Christian Stender Simonsen, Smørum (DK); Jesper Noehr Hansen, Smørum (DK)

(73) Assignee: Oticon A/S, Smorum (DK)

( * ) Notice: Subject to any disclaimer, the term of this patent is extended or adjusted under 35 U.S.C. 154(b) by 1107 days.

(21) Appl. No.: 11/375,096

(22) Filed: Mar. 15, 2006

(65) Prior Publication Data

US 2006/0222194 A1 Oct. 5, 2006

(30) Foreign Application Priority Data

Mar. 29, 2005 (EP) ..... 05102469

(51) Int. Cl.
*H04R 25/00* (2006.01)

(52) U.S. Cl. ..... 381/317; 381/312

(58) Field of Classification Search ..... 381/312–322, 381/60

See application file for complete search history.

(56) References Cited

U.S. PATENT DOCUMENTS 6,035,050 A 3/2000 Weinfurtner et al.
2004/0190739 A1 9/2004 Bachler et al.

FOREIGN PATENT DOCUMENTS

| | | | |
|---|---|---|---|
| CN | 1191060 | A | 8/1998 |
| EP | 0 335 542 | A2 | 10/1989 |
| EP | 0 335 542 | A3 | 10/1989 |
| WO | 96/41498 | A1 | 12/1996 |
| WO | 2004/008801 | A1 | 1/2004 |
| WO | WO-2004/056154 | A2 | 7/2004 |

*Primary Examiner*—Suhan Ni
(74) *Attorney, Agent, or Firm*—Birch, Stewart, Kolasch & Birch, LLP

(57) ABSTRACT

The present invention relates to a hearing aid logging data and learning from these data. The hearing aid (10, 100) comprises an input unit (12) converting an acoustic environment to an electric signal; an output unit (16) converting an processed electric signal to a sound pressure; a signal processing unit (14) interconnecting the input and output unit, and generating the processed electric signal from the electric signal according to a setting; a user interface (18) converting user interaction to a control signal thereby controlling the setting; and finally a memory unit (20) comprising a control section storing a set of control parameters associated with the acoustic environment, and a data logger section receiving data from the input unit (12), the signal processing unit (14), and the user interface (18); and wherein said signal processing unit (14) configures the setting according to the set of control parameters and comprises a learning controller adapted to adjust the set of control parameters according to the data in the data logging section.

21 Claims, 3 Drawing Sheets

HEARING AID FOR RECORDING DATA AND LEARNING THEREFROM

FIELD OF INVENTION

This invention relates to a hearing aid, such as a behind-the-ear (BTE), in-the-ear (ITE), or completely-in-canal (CIC) hearing aid, comprising a data recording means and a learning signal processing unit.

BACKGROUND OF INVENTION

In today's hearing aids data logging comprises logging of a user's changes to volume control during a program execution and of a user's changes of program to be executed. For example, European patent application no.: EP 1 367 857, which hereby is incorporated in the below specification by reference, relates to a data-logging hearing aid for logging logic states of user-controllable actuators mounted on the hearing aid and/or values of algorithm parameters of a predetermined digital signal processing algorithm.

Further, learning features of a hearing aid generally relate to data logging a user's interactions during a learning phase of the hearing aid, and to associating the user's response (changing volume or program) with various acoustical situations. Examples of this are disclosed in, for example, American patent no.: U.S. Pat. No. 6,035,050, American patent application no.: US 2004/0208331, and international patent application no.: WO 2004/056154, which all hereby are incorporated in the below specification by reference. Subsequent to the learning phase, the hearing aid during these various acoustical situations recalls the user's response and executes the program associated with the acoustical situation with an appropriate volume. Hence the learning features of these hearing aids do not learn from the acoustical environments but from the user's interactions and therefore the learning features are rather static.

Even though this type of data logging and learning provides improved means for a dispenser to adapt a hearing aid to a user, and thereby improving the quality of the hearing aid for the user, the known techniques do not provide a complete picture of which sounds in fact were presented to the user of the hearing aid causing the user to make changes to the volume or program selection.

SUMMARY OF THE INVENTION

An object of the present invention is therefore to provide a hearing aid, which overcomes the problems stated above. In particular, an object of the present invention is to provide a hearing aid adapting to the user of a hearing aid based on the user's interactions with the hearing aid as well as in accordance with the acoustic environments presented to the user.

A particular advantage of the present invention is the provision of an un-supervised learning hearing aid (i.e. not requiring user interaction), improves the adaptation of the hearing aid to the user, not only initially but also constantly.

A particular feature of the present invention is the provision of signal processing unit controlling a data logger recording the acoustic environments presented to the user and categorizing the acoustic environments in a predetermined set of categories.

The above object, advantage and feature together with numerous other objects, advantages and features, which will become evident from below detailed description, are obtained according to a first aspect of the present invention by a hearing aid for logging data and learning from said data, and comprising an input unit adapted to convert an acoustic environment to an electric signal; an output unit adapted to convert an processed electric signal to a sound pressure; a signal processing unit interconnecting said input and output unit and adapted to generate said processed electric signal from said electric signal according to a setting; a user interface adapted to convert user interaction to a control signal thereby controlling said setting; and a memory unit comprising a control section adapted to store a set of control parameters associated with said acoustic environment, and a data logger section adapted to receive data from said input unit, said signal processing unit, and said user interface; and wherein said signal processing unit is adapted to configure said setting according to said set of control parameters and comprising a learning controller adapted to adjust said set of control parameters according to said data in said data logging section.

The term "setting" is in this context to be construed as a predefined adjustment or tuning of a signal processing algorithm. The term "program" on the other hand is in the context of this application to be construed as a signal processing algorithm, a processing scheme, a dynamic transfer function, or a processing response.

Further, the term "acoustic environments" is in this context to be construed as ambient acoustic environment such as sound experienced in a busy street or library.

In addition, the term "dispenser" is in this context to be construed as an audiologist, a medical doctor, a medically trained person, a hearing health care professional, a hearing aid sale and fitting person, and the like.

The learning hearing aid according to the first aspect of the present invention thus may record not only the user's interactions through the user interface but may also monitor the acoustic environments in which the user is situated, and based on these data the learning hearing aid may adapt the hearing aid precisely to the individual user's hearing requirements.

The control section according to the first aspect of the present invention may further comprise a plurality of sets of parameters each associated with further acoustic environments. These sets of parameters may constitute a number of modes of operation or programs of the signal processing unit.

The data according to the first aspect of the present invention may comprise said electric signal, said setting, and said control signal. In fact, the electric signal may comprise a digital signal comprising a value for the sound pressure level, a value describing frequency spectrum of said acoustic environment, a value for noise of said acoustic environment, or any combination thereof. The setting may comprise a set of variables describing gain of one or more frequency bands, limits of said one or more frequency bands, maximum gain of said one or more frequency bands, compression dynamics of said one or more frequency bands, or any combination thereof. The control signal may comprise a value for volume of said sound pressure, selection of said set of parameters, or any combination thereof.

The input unit according to the present invention may comprise one or more microphones converting said acoustic environment to an analogue electric signal. The input unit may further comprise a converter for converting said analogue electric signal to said electric signal. The converter may further be adapted to generate a digital signal comprising a value for the sound pressure level, a value describing frequency spectrum of said acoustic environment, a value for noise of said acoustic environment, or any combination thereof. Hence the converter presents a wide range of acoustic environmental information to the data logger, which therefore continuously is updated with the behaviour of the user in respect of sound surroundings and the signal processing unit may accordingly learn from this behaviour.

The signal processing unit according to the first aspect of the present invention further comprise a directionality element adapted to generate a directionality signal indicating direction of sound source relative to normal of user's face. The directionality signal may be used by the signal processing unit for generating a gain of the sound received by the microphones relative to direction of sound source. That is, the amplification of sound received normal to the ear of the user, normal to the back of the user, or normal to the face of the user varies so that the largest amplification is given to sounds normal to the face of the user.

The signal processing unit according to the first aspect of the present invention may further comprise a noise reduction element adapted to generate a noise reduction signal indicating noise level of said acoustic environment. The signal processing unit may utilise the noise reduction signal for selecting an appropriate setting in which the noise is diminished.

The signal processing unit according to the first aspect of the present invention may further comprise an adaptive feedback element adapted to generate a feedback signal indicating feedback limit. The feedback limit is initially the maximally available stable gain in the hearing aid; however, the feedback limit may continuously be adjusted when the adaptive feedback element detects occurrences of positive acoustic feedback.

The data logger section according to the first aspect of the present invention may be adapted to log the directionality signal, the noise reduction signal, the feedback signal, together with the electric signal and control signal. Hence the data logger section may advantageously be adapted to log sound pressure level measured by the microphone(s) together with directionality and noise reduction program selections. Similarly, the data logger may be adapted to log volume control settings and changes thereof together with the measured sound pressure level.

Hence the signal processing unit may associate the measured sound pressure level with the noise reduction, the directionality and the volume control. This achieves an improved correlation between the sound pressure level and the user's perception as well as between the sound pressure level and the program selection. By logging these parameters the dispenser is provided better means for optimising the hearing aid for the user.

The learning controller according to the first aspect of the present invention may be adapted to average data logged during said acoustic environment. Thus the learning controller may generalise sets of parameters logged for a particular acoustic environment. In fact, the learning controller may be adapted to continuously update the sets of parameters with said data logged in the data logger. The learning controller ensures better listening for the user of the hearing aid in many different acoustic environments making the hearing aid very versatile. Further, the learning controller allows the user of the hearing aid to make and decide on compromises between comfort and speech intelligibility. These options give a larger degree of ownership to the user.

The learning controller according to the first aspect of the present invention may further be adapted to execute an unsupervised identity learning scheme for individualising parameters of the automatic program selection. The learning controller may comprise means for categorising a user in one of set of predefined identities. Different users of hearing aids have different lives and life styles and therefore some users require programs for more active life styles than others.

The learning controller according to the first aspect of the present invention may further comprise an identity learning scheme adapted to utilise the variability in acoustic environments, which reflect the activity level in life, and can be used to prescribe beneficial processing. The identity learning functionality of the learning controller ensures better listening in various acoustic environments, and determines an operation that matches the user's needs.

The signal processing unit according to the first aspect of the present invention may further comprise an own-voice detector adapted to generate an own-voice data. The own-voice data may be logged by the data logger. The signal processing unit may further comprise an own-voice controller adapted to execute an own-voice learning scheme utilising own-voice data logged in the data logger. The own-voice controller thereby may modify own-voice gain and other own voice settings in the hearing aid.

The learning hearing aid according to the first aspect of the present invention may further comprise an in-activity detector adapted to identify in-activity of the learning hearing aid. Thus the learning hearing aid reduces the learning functionality in situations wherein the hearing aid is not used i.e. worn by the user.

The above objects, advantages and features together with numerous other objects, advantages and features, which will become evident from below detailed description, are obtained according to a second aspect of the present invention by a method for logging data and learning from said data, and comprising: converting an acoustic environment to an electric signal by means of an input unit; converting an processed electric signal to a sound pressure by means of an output unit; interconnecting said input and output unit and generating said processed electric signal from said electric signal according to a setting by means of a signal processing unit; converting user interaction to a control signal thereby controlling said setting by means of a user interface; storing a set of control parameters associated with said acoustic environment by means of a control section of a memory unit; receiving data from said input unit, said signal processing unit, and said user interface by means of a memory unit of a data logger section; configuring said setting according to said set of control parameters by means said signal processing unit; and adjusting said set of control parameters according to said data in said data logging section by means of a learning controller.

The method according to the second aspect of the present invention may incorporate any features of the hearing aid according to the first aspect of the present invention.

The above objects, advantages and features together with numerous other objects, advantages and features, which will become evident from below detailed description, are obtained according to a third aspect of the present invention by a computer program to be executed on a signal processing unit according to the first aspect and including the actions of the method according to the second aspect of the present invention.

The computer program according to the third aspect of the present invention may incorporate any features of the hearing aid according to the first aspect or of the method according to the second aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein.

DETAILED DESCRIPTION OF PREFERRED EMBODIMENTS

In the following description of the various embodiments, reference is made to the accompanying figures, which show by way of illustration how the invention may be practiced. It is to be understood that other embodiments may be utilised and structural and functional modifications may be made without departing from the scope of the present invention.

Figure 1:
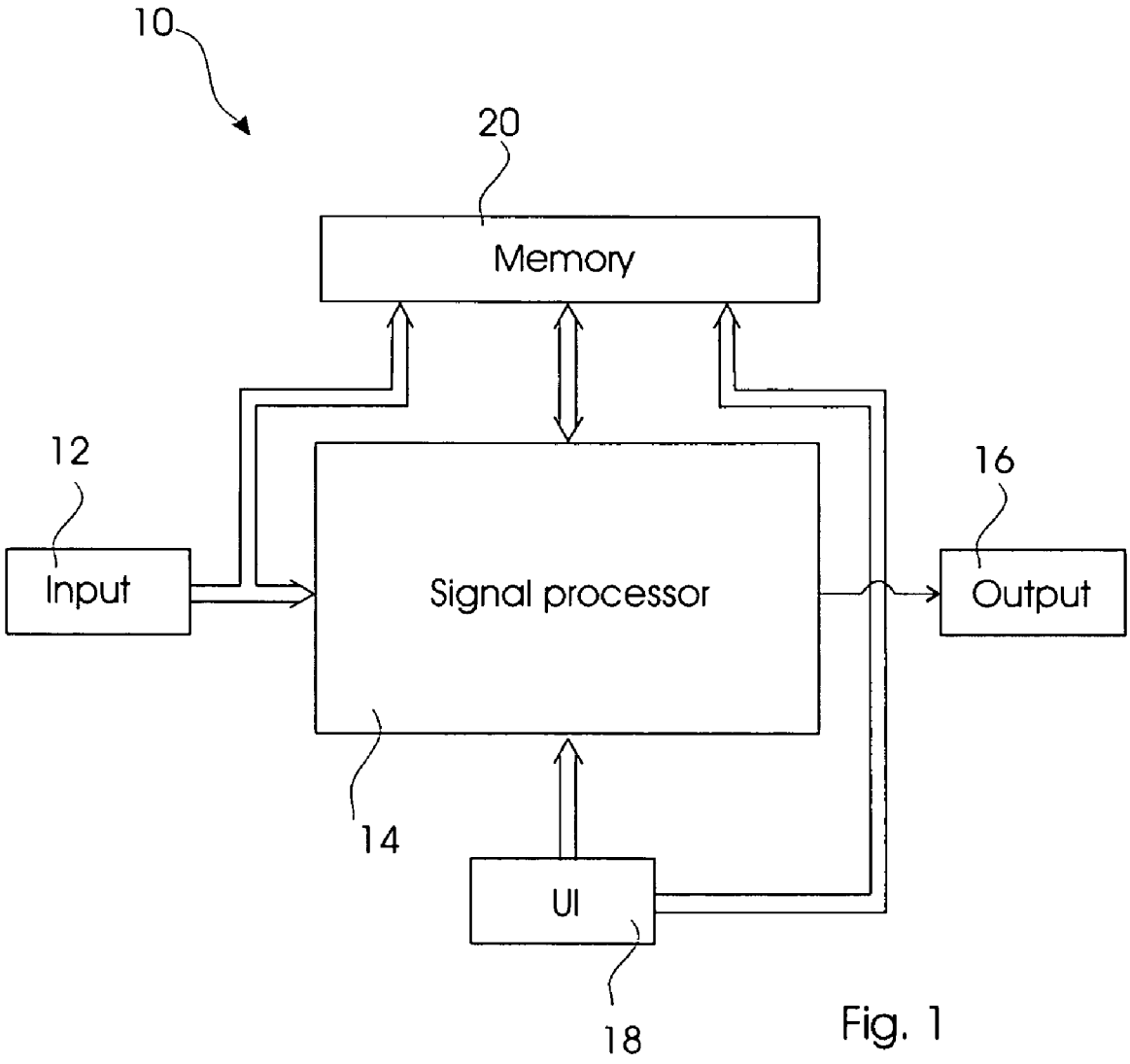
FIG. 1, shows a general block diagram of a learning hearing aid with a data logger according the first embodiment of present invention.

FIG. 1 shows a general block diagram of a learning hearing aid designated in entirety by reference numeral 10. The learning hearing aid 10 comprises an input unit 12 converting a sound to an electric signal or electric signals, which are communicated to a signal processing unit 14.

The signal processing unit 14 processes the incoming electric signal so as to compensate for the user's hearing disability. The signal processing unit 14 generates a processed electric signal for an output unit 16, which converts the processed electric signal to a sound pressure level to be presented to the user's ear canal.

The learning hearing aid 10 further comprises a user interface (UI) 18 enabling the user to change the setting of the signal processing unit 14, i.e. change the volume or the program.

The interactions of the user recorded by the UI 18 as well as the electric signal or signals of the input unit 12 are logged in a memory 20 together with the active setting of the signal processing unit 14.

The signal processing unit 14 utilises the data logged in the memory 20 for optimising the hearing aid 10 for the user. That is, the hearing aid 10 learns in accordance with the user's interactions as well as the acoustic environments the user operates in.

Figure 2:
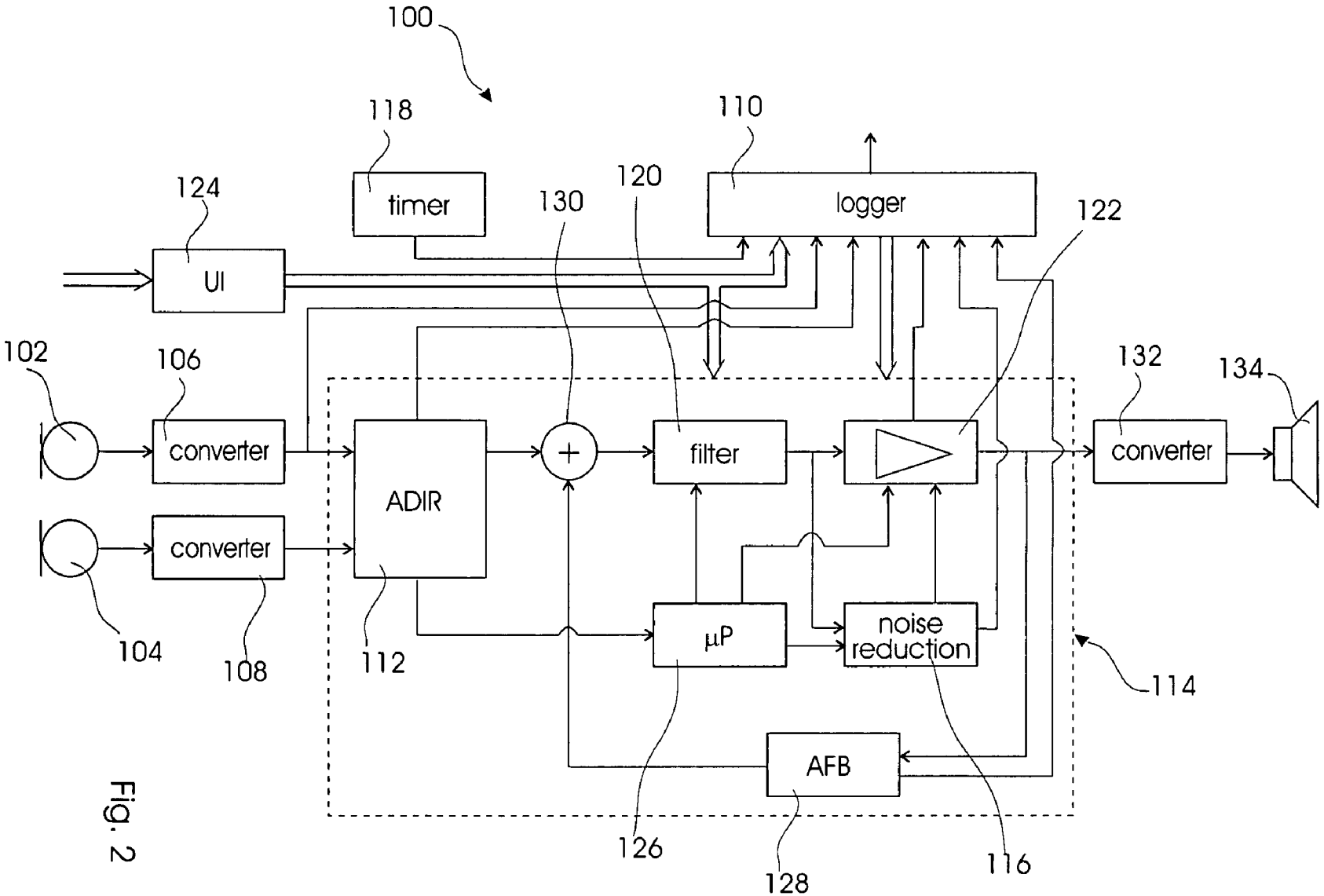
FIG. 2, shows a detailed block diagram of a learning hearing aid with a data logger according to a first embodiment of the present invention.

FIG. 2, shows a learning hearing aid according to a first embodiment of the present invention, which hearing aid is designated in entirety by reference numeral 100 and comprises a pair of microphones 102, 104 each converting sound pressure to analogue electric signals. Each of the analogue signals are communicated to converters 106, 108, which convert the analogue signals to digital signals. One of the digital signals is communicated from the converter 106 to a data logger 110 for logging a set of sound parameters, namely the sound pressure level measured by the microphone 102 and converted by the converter 106 to a digital signal; a directionality program selection determined by a directionality element 112 of a signal processing unit 114; a noise reduction program selection determined by noise reduction element 116 of the signal processing unit 114; time established by a timer element 118; and finally volume setting of an amplification element 122.

In addition, the data logger 110 logs the user's input for changing either program or volume setting of the signal processing unit 114 received through a user interface (UI) 124. The UI 124 enables the user to respond to the automatically selected program or volume setting and the respond is communicated directly to the signal processing unit 114 as well as the data logger 110.

The data logger 110 in the first embodiment of the present invention is configured in a memory such as a non-volatile memory. This memory further comprises one or more programs for the operation of the signal processing unit 114. The programs may be selected by the user of the hearing aid 100 through the UI 124 or may be automatically chosen by the signal processing unit 114 in accordance with a particular detected acoustic environment.

Hence the signal processing unit 114 operates in accordance with a number of programs determined by the directionality element 112 and the noise reduction element 116. Further, the signal processing unit 114 may be controlled by the user of the hearing aid 100 so as to select a different program. Thus the program of the signal processing unit 114, which is automatically determined by the directionality element 112 and/or the noise reduction element 116, or determined by the user, is continuously logged by the data logger 110.

The data logger 110 may be configured in a fixed area of the memory thus having a fixed capacity, and in this case the data logger 110 comprises a rolling or shifting function overwriting continuously discarding the oldest data in the data logger 110.

The content of the data logger 110 may be downloaded by a dispenser and utilised for, firstly, creating a picture of the user's actions/reactions to the hearing aid's 100 operation in various acoustic environments and, secondly, provide the dispenser with the possibility to adjust the operation of the hearing aid 100. The content may be downloaded by means of a wired or wireless connection to a computer by any means known to a person skilled in the art, e.g. RS-232, Bluetooth, TCP/IP.

The recording of the sound pressure level measured by the microphone 102 is, advantageously, used for comparing the user's response to the actual acoustic environments as well as for performing a correlation between the automatically selected program of the signal processing unit 114 and the actual acoustic environments. This provides the dispenser with the possibility to determine whether the parameters used for determining program selection match the resulting acoustic requirements of the user of the hearing aid 100.

The directionality element 112 determines a directionality program for the signal processing unit 114 based on the converted sound received by the microphones 102, 104. For example, the directionality element 112 performs a differentiation between the digital signals recorded at the first microphone 102 and the second microphone 104, and the differentiation is utilised for determining which directionality program would be optimal in the given acoustic environment.

The directionality element 112 forwards a directionality signal describing a preferable directionality program to a processor 126 of the signal processing unit 114. The processor 126 utilises the directionality signal for controlling the overall operation of the signal processing unit 114. The processor 126, in particular, controls the filtering element 120 and the amplification element 122 so as to compensate for the user's hearing loss. That is, the processor 126 seeks to provide compensation of hearing loss while ensuring that amplification does not exceed the maximum power limit of the user.

The noise reduction element 116 provides a noise reduction signal describing an appropriate noise reduction setting for the amplification element 122, which therefore improves the signal to noise ratio by utilising this program setting. The noise reduction signal is further, as described above, communicated to the data logger 110 for enabling the dispenser to check whether the functionality of the automatic program selection correlates with the actual acoustic environments.

The timer element 118 forwards a timing signal to the data logger 110 thereby controlling the data logger 110 to store data on its inputs at particular intervals. The timer element 118 further enables the data logger 110 to log a value of time.

The hearing aid 100 further comprises an adaptive feedback system 128 measuring the output of the amplification unit 122 and returning a feedback signal to a summing point 130 of the signal processing unit 114. The adaptive feedback system 128 detects occurrences of positive acoustic feedback and adaptively adjusts the feedback limits over time. The feedback limit is initially the maximum available stable gain in the hearing aid 100; however, the feedback limit is continuously adjusted in accordance with the acoustic environments of the user of the hearing aid 100 and with the user's way of using the hearing aid 100. This learning feature is unsupervised (i.e. no interaction from the user is needed) and therefore attractive. Hence the adaptive feedback system 128 has the ability to detect, count and reduce the number of feedback occurrences in each frequency band.

The hearing aid 100 further comprises a converter 132 for converting the output of the signal processing unit 114 for a signal appropriate for driving a speaker 134. The speaker 134 (also known as a receiver within the hearing aid industry) converts the electrical drive signal to a sound pressure level presented in the user's ear.

The signal processing unit 114 further comprises a learning feedback controller, which is activated when the adaptive feedback system 128 has reached its maximum performance and some howls are still detected. The input to the learning feedback controller is derived from the adaptive feedback system 128, which means that the basic functionality depends on the effectiveness of the adaptive feedback system 128. The object of the learning feedback controller is to provide less feedback over time—on top of an already robust feedback cancellation system. Furthermore, there is less need to run the static feedback manager, which sets the feedback limit in a fitting session in a hearing care clinic.

The learning feedback controller comprises two different degrees of adaptation to changing acoustic conditions. A fast-acting system for fast changes (within seconds), e.g. telephone conversation, and a more consistent slow-acting system that learns from the long-term tendencies in the fast-acting system.

The learning process of the hearing aid 100 takes place on two different time scales. Firstly, a fast-acting learning scheme initiated and executed by the learning feedback controller provides support in situations where the adaptive feedback system 128 cannot handle the feedback correctly. The fast-acting learning scheme reacts according to the feedback limit and is used when the acoustics changes temporarily, for example, when wearing a hat, using a telephone or hugging. Another example of changed acoustic environments could be the small differences in insertion of the hearing aid 100 in the ear from day to day.

Howl and near-howl occurrences are detected by the adaptive feedback system 128 and integrated over a short time frame in a number of frequency bands, e.g. sixteen.

These fast-acting learning actions are stored in a volatile memory and are therefore forgotten by the next day or the next time the hearing aid is switched "On".

Figure 3:
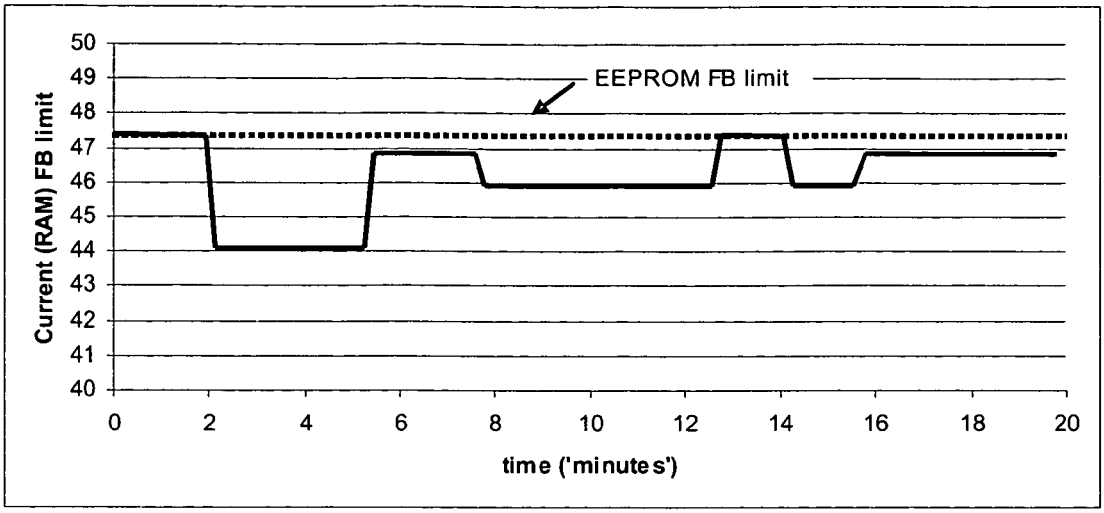
FIG. 3, shows a graph of a fast-acting learning scheme of a learning controller according to the first embodiment.

FIG. 3 illustrates this fast-acting learning scheme of the learning feedback controller within one "On" period. The X-axis of the graph shows time in minutes, while the Y-axis of the graphs shows the current feedback limit stored in the volatile memory. The dotted line illustrates the maximum feedback limit stored in the non-volatile memory, while the other line shows how the current feedback limit changes as a function of time. There is a hold-off period after switching the instrument on, e.g. 1 minute. There will also be a maximum limit of the fast-acting adjustment of 10 dB.

When there is a consistent change in the acoustic environments, for example, due to ear wax problems in the ear canal, or if the user of the hearing aid 100, for some reason, has been prescribed with the wrong ear mould or in case of unpredictable acoustical connections between hearing aid and ear, then a more durable learning is activated by the learning feedback controller.

Hence if the fast-acting learning scheme has shown a consistent trend, then a permanent change in the feedback limit is written in the non-volatile memory.

Figure 4:
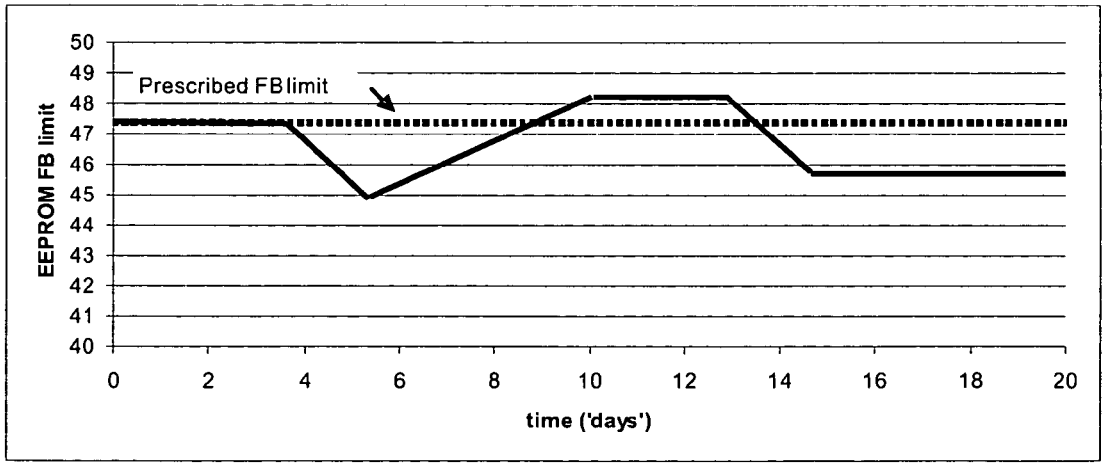
FIG. 4, shows a graph of a slow-acting learning scheme a learning controller according to the first embodiment.

The input to this slow-acting learning scheme of the learning feedback controller is taken from the fast-acting learning scheme. The fast-acting input is exponentially averaged and stored in the non-volatile memory at regular intervals and read the next time the hearing aid 100 is switched "On". The permanent feedback limit may exceed the initially prescribed feedback limit up to a certain limit as illustrated in FIG. 4. The time constant of this scheme is no less than 8 hours of use.

FIG. 4 illustrates this slow-acting learning scheme of the learning feedback controller over any number of "on" sessions. The X-axis of the graph shows time in days, while the Y-axis of the graphs shows the maximum feedback limit stored in the non-volatile memory. The dotted line illustrates the maximum feedback limit stored in the non-volatile memory, while the other line shows how the current feedback limit changes as a function of time.

The signal processing unit 114 further comprises a user controller for controlling the data logging and learning of the user's interactions recorded through the UI 124.

Normally a user of the hearing aid 100 adjusts the volume to a best setting in daily use in all acoustic environments where adjustments are desired. For example, the user may prefer a higher volume only in quiet situations compared to the setting programmed by the dispenser then the increased gain in quiet is also applied to all other sounds. Further more, the setting is forgotten the next time the user switches "On" the hearing aid 100. If the volume control actions are memorized for a specific acoustic environment (or other relevant parameters) the need for changing the volume control over time is thus reduced.

The user controller executes a volume control learning scheme based on a special volume state matrix illustrated in table 1 below. For each state, i.e. combination of sound pressure level region (input level) and acoustic environment a specific additional gain is applied. Initially this additional gain is the same regardless of which state the hearing aid 100 is in. When the learning volume control scheme is active each state is logged in the data logger 110 and learned separately, and this may over time lead to noticeable changes in gain of the amplification element 122 depending on how the volume control is used by the user of the hearing aid 100.

The data logger 110 comprises a logging buffer for each volume state, which buffer needs to be full before learning takes place. As described above, the setting of the volume control of the hearing aid 100, the sound pressure level of the acoustic environments and some further environment data are logged in the data logger 110. This means that after a certain amount of user time the volume states will contain mean or averaged data of the volume control use, where after volume control learning scheme can be initialized and effectuated.

| | | Input level (dB SPL) | | |
|---|---|---|---|---|
| | | Low-45 | Medium 45-75 | High 75- |
| Environment Detector | Speech | VC1 | VC2 | VC3 |
| | Comfort | VC4 | VC5 | VC6 |
| | Wind | | VC7 | |

Table 1 shows a matrix for handling different volume states (i.e. speech, comfort, wind, low, medium and high) together with learning volume control actions (VC1 through VC7). The matrix is two dimensional: one dimension is the (broadband) sound pressure level in three regions, low, medium and high. Another dimension is directed by an environment detector that detects a specific acoustic environment.

When the gain changes in a specific volume state the change will affect the forthcoming states to the same extend. If the user prefers an overall gain change (i.e. regardless of sound pressure level and acoustic environments) then the same volume change is required in all volume states, and the volume control learning scheme executed by the user controller might reduce the need for future changes. For most users there is a need to adjust gain differently for different sound pressure levels and for different acoustic environments. This would imply that a global change in gain in one volume state will result in an unwanted change in another volume state. Consequently, such users need to set the volume control according to the preferred volume for a specific sound pressure level and a specific acoustic environment. After a couple of changes in the volume states where volume control learning scheme is executed in each volume state these users will hopefully reduce their need for the volume control. All effects of the volume control learning scheme are written to the non-volatile memory at regular intervals.

In use, the volume control is program-specific. The volume control setting is remembered for each program and is restored when the user returns to an associated program (e.g. switching to tele-coil or music program). By executing the volume control learning scheme separately within each program, the learning scheme will accommodate various input sources. Additional programs like tele-coil and music program are treated differently than the general programs because the input source to these auxiliary programs is not as complex as in the general programs and thus the logging and learning will follow a simpler scheme.

Below in table 2 a special learning scheme for additional programs is illustrated.

| Input level (dB) | | |
|---|---|---|
| Low-45 | Medium 45-75 | High 75- |
| VC8 | VC9 | VC10 |

Since these additional programs such as a telecoil program or music program are simpler the matrix for these programs is simpler. The matrix is one-dimensional having a series of volume control states (low, medium, high) for a series of volume control actions (VC8 through VC10).

The signal processing unit 114 further comprises an identity controller adapted to execute an un-supervised identity learning scheme for individualising parameters of the automatic program selection. In particular, the parameters comprise the type of parameters, which are difficult to prescribe accurately in a hearing care facility and without knowledge about the user's actual sound environment.

The prior art hearing aids comprise a number of identities or profiles each describing a specific user. For example, an identity for a younger user may include settings of the programs, which are significantly different to an identity for an older user. The dispenser fitting the hearing aid 100 to the user pre-selects an identity from the number of identities.

Figure 5:
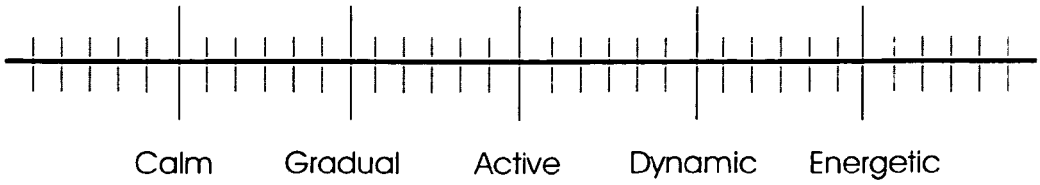
FIG. 5, shows profiles of the hearing aid according to a first embodiment of the present invention.

In the hearing aid 100 according to the first embodiment of the present invention five activity identities are envisaged and shown in FIG. 5.

The identity learning scheme utilises that the variability in a given user's acoustic environments reflects his activity level in life, and can be used to prescribe beneficial processing. For example, a user that experience a highly variable acoustic environment will have a greater possibility to benefit from a faster acting identity (moving right on the identity scale shown in FIG. 5) and vice versa.

The identity learning scheme of the on-line identity controller ensures possibility of changing the configuration of the automatic signal processing like directionality, noise reduction and compression over time as a product of gained knowledge about the user's acoustic environments, i.e. enables further individualisation of the identity setting. Consequently if the logged data in the data logger 110 indicate that the user is experiencing another kind of acoustic environment than is anticipated according to the prescribed or pre-selected identity, the hearing aid 100 automatically adjusts itself to a configuration that is hypothesized to be more beneficial.

Five new sub-identities are defined between each main identity. The five main identities are defined by a wide range a parameters from compression (e.g. speed, level dependent gain), noise reduction (e.g. amount of gain reduction, speed, and threshold), and directionality (e.g. threshold).

At least one parameter is required in order to point on the correct place on the identity scale (FIG. 5). Such a parameter needs to be defined on the basis of several logging parameters. The parameter is based on histograms of distribution of programs over time (indirect knowledge about acoustic environments) and histograms of input sound pressure level variation over time and the number of modes transitions (how fast the automatic program selection adapts to the acoustic environment over time). The different modes may have different priorities, e.g. speech mode information could weight more than comfort mode.

The signal processing unit 114 further comprises an own-voice detector (OVD) for generating an own-voice profile, which is logged in the data logger 100. The own-voice profile is utilised by an own-voice controller of the signal processing unit 114 for executing an own-voice learning scheme during which the hearing aid 100 utilises data logged in the data logger 110 to modify own voice gain and other own voice settings in the instrument.

The own voice learning requires the OVD, is used to detect own voice. In the presence of an own voice (i.e. speaking situation) the setting in the instrument will be modified according to an own voice rationale (algorithm). The own voice learning will try to individualise this rationale according to how the user of the hearing aid 100 speaks.

One of the biggest risks with the concept of a learning hearing aid 100 is if the logged data are invalid due to a situation where the hearing aid 100 is switched "On" but not worn by the user. If the hearing aid 100 has been collecting data, while lying on a table or in the carrying case, there is great risk that learning takes an unwanted direction. For example, if the hearing aid has been howling in the carrying case for a couple of days then the maximum feedback limit would be reduced. Therefore the hearing aid 100 further comprises an in-activity detector detecting when the hearing aid 100 is not worn and disabling logging of data during inactivity. Alternatively, the in-activity detector when detecting that the hearing aid 100 is not worn mutes the microphones 102, 104 and terminates the logging of data and the process of learning.

The in-activity detector accomplishes a beneficiary feature of the hearing aid 100 in that it saves battery life if the hearing aid 100 by its self is able to mute during in-activity. The in-activity detector combines logged data in the data logger 110 in a way that minimizes false positive responses. The following logging parameter may be used: the fast-acting average from the learning feedback controller; average sound pressure level; usage time; variation in sound pressure level; state of the automatic program selection; or user interactions such as volume or program selection or lack thereof.

By monitoring the fast-acting average from a number of parameters of the learning feedback controller the in-activity detector may identify when the more than one parameters average approaches a maximum and accordingly the signal processing unit 114 may mute the hearing aid 100.

By monitoring the average sound pressure level the in-activity detector may identify when the sound pressure level approaches a very low level over longer period of time, for example, during the night, the signal processing unit 114 may mute the hearing aid 100.

By monitoring the variation in sound pressure level the in-activity detector may identify when the sound pressure level changes, for example, the sound pressure level changes when going from inside to outside, and the sound pressure level does not significantly change when the hearing aid 100 is positioned in a drawer, therefore the signal processing unit 114 may mute the hearing aid 100 when no change has been identified over a longer period of time.

By monitoring the variation in state of the automatic program selection the in-activity detector may as described above with reference to variation of sound pressure level mute the hearing aid 100 when no variation in the automatic program selection is identified over a longer period of time.

By monitoring the variation in user interactions the in-activity detector may from a longer period of no user interactions react by flagging in-activity where after the signal processing unit 114 may mute the hearing aid 100.

The invention claimed is:

1. A hearing aid for logging data and learning from said data, comprising:

an input unit configured to convert an acoustic environment to an electric signal;

an output unit configured to convert a processed electric signal to a sound pressure;

a signal processing unit interconnecting said input and output unit and configured to generate said processed electric signal from said electric signal according to a setting;

a user interface configured to convert user interaction to a control signal thereby controlling said setting; and a memory unit including a control section configured to store a set of control parameters associated with a user identity, and a data logger section configured to receive data from said input unit, said signal processing unit, and said user interface, wherein said signal processing unit configures said setting according to said set of control parameters corresponding to the user identity and includes a learning controller configured to execute un-supervised identity learning based on data logged by the data logger and adjust said set of control parameters according to the learned identity.

2. A hearing aid according to claim 1, wherein said control section further comprises a plurality of sets of parameters each associated with further acoustic environments.

3. A hearing aid according to any of claims 1 to 2, wherein said data comprises said electric signal, said setting, and said control signal.

4. A hearing aid according to claim 3, wherein said electric signal comprises a digital signal comprising a value for the sound pressure level, a value describing frequency spectrum of said acoustic environment, a value for noise of said acoustic environment, or any combination thereof.

5. A hearing aid according to claim 3, wherein said setting comprises a set of variables describing gain of one or more frequency bands, limits of said one or more frequency bands, maximum gain of said one or more frequency bands, compression dynamics of said one or more frequency bands, or any combination thereof.

6. A hearing aid according to claim 3, wherein said control signal comprises a value for volume of said sound pressure, selection of said set of parameters, or any combination thereof.

7. A hearing aid according to claim 1, wherein said input unit comprises one or more microphones converting said acoustic environment to an analogue electric signal, a converter for converting said analogue electric signal to said electric signal, wherein said converter is configured to generate a digital signal comprising a value for the sound pressure level, a value describing frequency spectrum of said acoustic environment, a value for noise of said acoustic environment, or any combination thereof.

8. A hearing aid according to claim 1, wherein said signal processing unit further comprises a directionality element configured to generate a directionality signal indicating direction of sound source relative to normal of user's face.

9. A hearing aid according to claim 8, wherein said data logger section is configured to log the directionality signal, the noise reduction signal, the feedback signal, together with the electric signal and control signal.

10. A hearing aid according to claim 9, wherein said data logger is configured to log volume control settings and changes thereof together with the measured sound pressure level.

11. A hearing aid according to claim 1, wherein said signal processing unit further comprises a noise reduction element configured to generate a noise reduction signal indicating noise level of said acoustic environment.

12. A hearing aid according to claim 1, wherein said signal processing unit further comprises an adaptive feedback element configured to generate a feedback signal indicating feedback limit.

13. A hearing aid according to claim 1, wherein said learning controller further comprises an identity learning scheme configured to utilise the changes in acoustic environments.

14. A hearing aid according to claim 1, wherein said signal processing unit further comprises an own-voice detector configured to generate an own-voice data in said data logger section, and an own-voice controller configured to execute an own-voice learning scheme utilising own-voice data logged in said data logger section.

15. A hearing aid according to claim 1, further comprising:

an in-activity detector configured to identify in-activity of the learning hearing aid.

16. A computer readable recording medium encoded with instructions wherein the instructions, when executed on a signal processing unit according claim 1, cause the signal processing unit to perform a method comprising:

converting an acoustic environment to an electric signal by an input unit;

converting a processed electric signal to a sound pressure by an output unit;

interconnecting said input unit and said output unit and generating said processed electric signal from said electric signal according to a setting by a signal processing unit;

converting user interaction to a control signal thereby controlling said setting by a user interface;

storing a set of control parameters associated with a user identity by a control section of a memory unit;

receiving data from said input unit, said signal processing unit, and said user interface by a data logger section of the memory unit;

configuring said setting according to a set of control parameters corresponding to the user identity by said signal processing unit; and executing un-supervised identity learning to learn the user identity based on data logged by the data logger; and adjusting said set of control parameters according to the learned identity.

17. The hearing aid according to claim 1, wherein the learning controller determines variability in the user's acoustic environments based on the data logged by the data logger, and selects the user identity based on the determined variability.

18. A method for logging data and learning from said data, comprising:

converting an acoustic environment to an electric signal by an input unit;

converting a processed electric signal to a sound pressure by an output unit;

interconnecting said input unit and said output unit and generating said processed electric signal from said electric signal according to a setting by a signal processing unit;

converting user interaction to a control signal thereby controlling said setting by means of a user interface;

storing a set of control parameters associated with a user identity by a control section of a memory unit;

receiving data from said input unit, said signal processing unit, and said user interface by a data logger section of the memory unit;

configuring said setting according to a set of control parameters corresponding to the user identity by said signal processing unit;

executing un-supervised identity learning to learn the user identity based on data logged by the data logger; and adjusting said set of control parameters according to the learned identity.

19. The method according to claim 18, further comprising:

determining variability in the user's acoustic environments based on the data logged by the data logger; and selecting the user identity based on the determined variability.

20. A method of reducing feedback-induced howling in a hearing aid having an adaptive feedback cancellation system, the method comprising:

operating the adaptive feedback cancellation system based on a starting value of a feedback limit in at least one frequency band;

detecting occurrences of feedback-induced howling in the at least one frequency band;

counting a number of the detected occurrences within a first time period;

changing the feedback limit of the hearing aid unit based on the number of the detected occurrences;

averaging feedback limit changes within a second time period longer than the first time period;

computing a changed starting value for the feedback limit based on the averaged feedback limit changes; and storing the changed starting value as the staffing value of the feedback limit in a non-volatile memory.

21. A hearing aid, comprising:

an adaptive feedback cancellation system configured to operate based on a staffing value of a feedback limit within at least one frequency band;

a non-volatile memory storing the staffing value of the feedback limit; and a feedback controller including a detector configured to detect occurrences of feedback-induced howling in the at least one frequency band, a counter configured to count a number of the detected occurrences within a first time period, a changing unit configured to change the feedback limit of the hearing aid unit based on the number of the detected occurrences, an averaging unit configured to average feedback limit changes within a second time period longer than the first time period, and a computing unit configured to compute a changed staffing value for the feedback limit based on the averaged feedback limit changes, wherein the non-volatile memory stores the changed staffing value as the staffing value of the feedback limit.

* * * * *